United States Patent [19]

Mathison

[11] Patent Number: 4,974,279

[45] Date of Patent: Dec. 4, 1990

[54] BACK BRUSH APPARATUS

[76] Inventor: Kevin G. Mathison, Box 184, Medsead, Saskatchewan, Canada, S0M 1W0

[21] Appl. No.: 381,474

[22] Filed: Jul. 18, 1989

[51] Int. Cl.[5] ..... A46B 9/00

[52] U.S. Cl. ..... 15/160; 15/206; 15/222; 15/DIG. 5

[58] Field of Search ..... 15/143 R, 159 R, 159 A, 15/160, 207, 206, 222, DIG. 3, DIG. 5, DIG. 6; D4/130, 131

[56] References Cited

U.S. PATENT DOCUMENTS

| | | | |
|---|---|---|---|
| 1,337,819 | 4/1920 | Braun | 15/206 |
| 1,621,900 | 3/1927 | Pretat | 15/206 |
| 1,864,379 | 6/1932 | Tailor | 15/222 |
| 2,318,680 | 5/1943 | Ellinger | 15/160 |
| 2,905,957 | 9/1959 | Volpe | 15/222 |
| 2,913,756 | 11/1959 | MacFarland | 15/206 |
| 3,024,486 | 3/1962 | Naugle | 15/222 |
| 3,063,081 | 11/1962 | Brown | 15/222 |
| 3,103,679 | 9/1963 | Clemens | 15/DIG. 6 |
| 3,130,441 | 4/1964 | Hahn | 15/222 |
| 3,935,611 | 2/1976 | Locher | 15/160 |
| 3,936,198 | 2/1976 | Martin | 15/222 |
| 4,014,064 | 3/1977 | Okazaki | 15/DIG. 5 |
| 4,395,943 | 8/1983 | Brandli | 15/206 |

FOREIGN PATENT DOCUMENTS

| | | | |
|---|---|---|---|
| 2716101 | 4/1978 | Fed. Rep. of Germany | 15/206 |
| 320134 | 5/1902 | France | 15/160 |
| 1059066 | 11/1953 | France | 15/160 |

*Primary Examiner*—Harvey C. Hornsby
*Assistant Examiner*—Mark Spisich
*Attorney, Agent, or Firm*—Leon Gilden

[57] ABSTRACT

A back brush apparatus is provided with a flexible, helically wound wire core coaxially arranged through the brush containing a series of three separate sets of bristles, each randomly arranged with one another throughout the brush matrix defining a cylinder about the wire core. The first longest series of bristles are of a relatively soft character with the shortest and third series of bristles being of the stiffest character, with the second series of bristles being of intermediate length and stiffness relative to the first and third series. A hand loop is secured to a loop formed at each terminal end of the wire core and secured to the wire loop by means of a fastener to enable reciprocating the brush during use by an individual.

1 Claim, 1 Drawing Sheet

BACK BRUSH APPARATUS

BACKGROUND OF THE INVENTION

1. Field of the Invention

The field of invention relates to brushes, and more particularly relates to a new and improved back brush apparatus wherein the same includes a brush matrix of bristles of various stiffnesses to enhance cleansing by varying application of pressure by an individual to the brush during use.

2. Description of the Prior Art

The use of brushes and back brushes of various types have been known in the prior art. The prior art, however, has failed to provide a back brush arrangement wherein the bristles are of varying lengths and stiffnesses to enable an individual to vary the cleansing action upon an individual's body surface by varying the pressure applied to the brush during use. For example, U.S. Pat. No. 2,905,957 to Volpe provides for a central brush with flexible handles extending outwardly therefrom that are spring-biased relative to the brush arrangement to accommodate varying pressures applied to the brush in its application over a body surface.

U.S. Pat. No. 3,024,486 to Naugle sets forth a back scrubbing brush wherein a flexible belt is secured to each end of a scrubbing block for application to a body surface of an individual.

U.S. Pat. No. 3,063,081 to Brown sets forth a medially positioned sponge, and alternatively a fibrous core with a central flexible strap directed therethrough.

U.S. Pat. No. 3,130,441 to Hahn sets forth a back brush cloth wherein a cake of soap is positioned medially and sandwiched within a fabric container with handles directed outwardly through each end of the container for application of soap and scrubbing to an exterior surface of an individual.

U.S. Pat. No. 3,936,198 to Martin sets forth a cord directed through a central cylindrical member wherein the central cylindrical member includes a series of perforations to enable soap and the like to be directed therethrough during application of the central brush to the exterior surface of an individual.

As such, it may be appreciated that there is a continuing need for a new and improved back brush apparatus wherein the same addresses both the problems of effecting a cleansing action by varying the application of pressure to the brush and in this respect, the present invention substantially fulfills this need.

SUMMARY OF THE INVENTION

In view of the foregoing disadvantages inherent in the known types of back brush apparatus now present in the prior art, the present invention provides a back brush apparatus wherein the same utilizes bristles of varying stiffnesses and lengths to effect a cleansing operation dependent upon pressure applied to the brush. As such, the general purpose of the present invention, which will be described subsequently in greater detail, is to provide a new and improved back brush apparatus which has all the advantages of the prior art back brush apparatus and none of the disadvantages.

To attain this, the present invention includes a central wire core helically wound to secure a cylindrical brush matrix thereabout. The brush matrix includes three separate series of brushes randomly oriented relative to one another, with a first and longest length of bristle of a relatively soft characteristic relative to a third and shortest series of bristles with a second intermediate series of bristles of intermediate length and stiffness relative to the first and third series whereupon variation of pressure applied to the brush will impose various proportions of the first, second, and third series of bristles onto a surface being cleansed. The central wire core includes wire loops at each end for accommodation and securement of flexible handle loops for manual grasping by an individual during use of the brush.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved back brush apparatus which has all the advantages of the prior art back brush apparatus and none of the disadvantages.

It is another object of the present invention to provide a new and improved back brush apparatus which may be easily and efficiently manufactured and marketed.

It is a further object of the present invention to provide a new and improved back brush apparatus which is of a durable and reliable construction.

An even further object of the present invention is to provide a new and improved back brush apparatus which is susceptible of a low cost of manufacture with regard to both materials and labor, and which accordingly is then susceptible of low prices of sale to the consuming public, thereby making such back brush apparatus economically available to the buying public.

Still yet another object of the present invention is to provide a new and improved back brush apparatus which provides in the apparatuses and methods of the prior art some of the advantages thereof, while simultaneously overcoming some of the disadvantages normally associated therewith.

Still another object of the present invention is to provide a new and improved back brush apparatus wherein the same includes bristles of varying stiffnesses and lengths to effect cleansing of an exterior surface of an individual dependent upon the degree of application of pressure applied to the brush.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
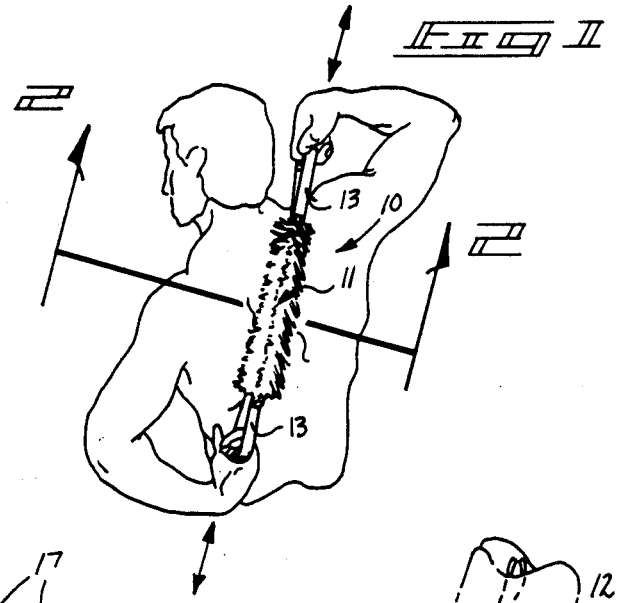
FIG. 1 is an isometric illustration of the instant invention applied to an exterior surface of an individual.
Figure 2:
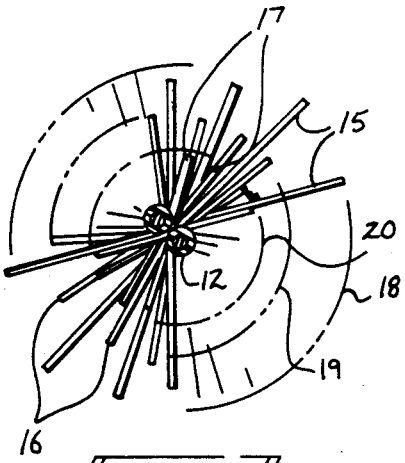
FIG. 2 is an orthographic view taken along the lines 2—2 of FIG. 3 in the direction indicated by the arrows.
Figure 3:
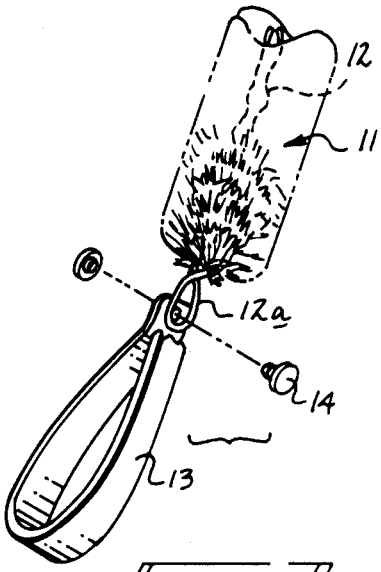
FIG. 3 is an isometric illustration, somewhat expanded, of the securement of the handle loops to the wire loops of the central wire core.

With reference now to the drawings, and in particular to FIGS. 1 to 3 thereof, a new and improved back brush apparatus embodying the principles and concepts of the present invention and generally designated by the reference numeral 10 will be described.

More specifically, the back brush apparatus 10 essentially comprises a bristle matrix 11 defined as an elongate cylindrical member with an axial sprially wound central core 12 formed of a plurality of spirally wound wires coated with a polymeric layer to protect the wires against oxidation and minimize abrasion to a user in the event of inadvertent contact with the core and the individual. The spirally wound core includes a wire core terminating end loop **12*a* at each end thereof to receive a flexible handle loop 13 with each end of the handle loop formed with a through-extending aperture that in turn receives a lock fastener 14 therethrough. The brush bristle matrix 11 includes three series of wire brushes of varying stiffnesses wherein the three series include a first bristle series 15, second bristle series 16, and a third bristle series 17. The first bristles 15 are of the softest characteristic relative to the third bristle series 17 that are the hardest and stiffest of the group. The second bristle series 16 are of an intermediate length and stiffness relative to the first and third series. Further, the first bristles 15 define a first diameter 18 of a first length, the second bristles 16 are of a second intermediate length to define a second diameter 19 of an intermediate diametrical length, and the third bristle series 17 are of the stiffest and hardest bristles and define a third diameter 20 of a shortest diameter relative to the first and second diameters 18 and 19. Each of the diameters 18, 19, and 20 are coaxially aligned relative to one another within the bristle brush matrix 11**.

It should be understood therefore that during use the user of the apparatus 10 may determine the amount of cleansing and abrasion relative to the individual's surface and control that abrasion by the pressure applied and the amount of massaging and cleansing effected thereby during use of the apparatus.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A back brush apparatus comprising, a cylindrical bristle brush matrix, and an elongate flexible wire core including a plurality of helically wound wires coaxially directed through the bristle brush matrix and terminating in wire end loops at each end of the wire core, and flexible handle loops secured to each wire end loop, and wherein the bristle matrix comprises a first, second, and third series of brush bristles, and wherein the first series of brush bristles are of a first length, the second series of brush bristles are of a second length less than the first length, and a third series of brush bristles are of a third length less than the second length, and wherein the first series of brush bristles are of a first stiffness, the second series of brush bristles are of a second stiffness greater than the first stiffness, and the third series of brush bristles are of a third stiffness greater than the second stiffness, and wherein the first, second, and third series of brush bristles are randomly dispersed about and along the length of the flexible wire core, and wherein the elongate flexible wire core is coated with a polymeric coating to minimize oxidation of the wire core and minimize abrasion during inadvertent contact of the wire core with an individual.

* * * * *